US010249968B2

(12) United States Patent
Dandl et al.

(10) Patent No.: US 10,249,968 B2
(45) Date of Patent: Apr. 2, 2019

(54) PLUG-AND-SOCKET CONNECTOR

(71) Applicant: Rosenberger Hochfrequenztechnik GmbH & Co. KG, Fridolfing (DE)

(72) Inventors: Christian Dandl, Fridolfing (DE); Martin Räthlein, Saaldorf-Surheim (DE); Bernhard Aicher, Fridolfing (DE); Sylvester Mühlbacher, Fridolfing (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 15/735,188

(22) PCT Filed: Oct. 4, 2016

(86) PCT No.: PCT/EP2016/001634

§ 371 (c)(1),
(2) Date: Dec. 10, 2017

(87) PCT Pub. No.: WO2017/059950

PCT Pub. Date: Apr. 13, 2017

(65) Prior Publication Data

US 2018/0301834 A1 Oct. 18, 2018

(30) Foreign Application Priority Data

Oct. 7, 2015 (DE) ..... 20 2015 007 010 U

(51) Int. Cl.
*H01R 13/648* (2006.01)
*H01R 12/70* (2011.01)
(Continued)

(52) U.S. Cl.
CPC ..... *H01R 12/7082* (2013.01); *H01R 12/716* (2013.01); *H01R 12/73* (2013.01);
(Continued)

(58) Field of Classification Search
CPC ..... H01R 13/20; H01R 13/6277; H01R 12/7082; H01R 12/716; H01R 24/50; H01R 24/542; H01R 2103/00
(Continued)

(56) References Cited

U.S. PATENT DOCUMENTS 3,686,623 A * 8/1972 Nijman ..... H01R 4/52 439/581
3,977,752 A * 8/1976 Freitag ..... H01R 9/05 439/411
(Continued)

FOREIGN PATENT DOCUMENTS

CN 202308448 U 7/2012
CN 103337740 B 4/2015
WO 20100131912 A2 11/2010

*Primary Examiner* — Abdullah A Riyami
*Assistant Examiner* — Vladimir Imas
(74) *Attorney, Agent, or Firm* — David P. Dickerson

(57) ABSTRACT

A connector (2, 2*a*, 44*a*, 44*b*, 44*c*) for the HF signal-transmitting connection of two components (4*a*, 4*b*), in particular a board-to-board connector for the HF signal-transmitting connection of two circuit boards to each other, comprising a first connecting piece (6*a*) for fastening to the first components (4*a*) and comprising a second connecting piece (6*b*) for fastening to the second component (4*b*), and comprising an intermediate piece (8, 56) including a first end (10) for connection to the first connecting piece (6*a*) and including a second end (12) for connection to the second connecting piece (6*b*), wherein, in order to form a detent connection for fixing the connection, the first connecting piece (6*a*) and the second connecting piece (6*b*) each comprise a first detent means (14*a*, 14*b*), wherein the first end (10) is designed to be free from detent means and the second end (12) comprises a second detent means (16) designed for interacting with the first detent means (14*a*, 14*b*).

23 Claims, 7 Drawing Sheets

Figure 1:
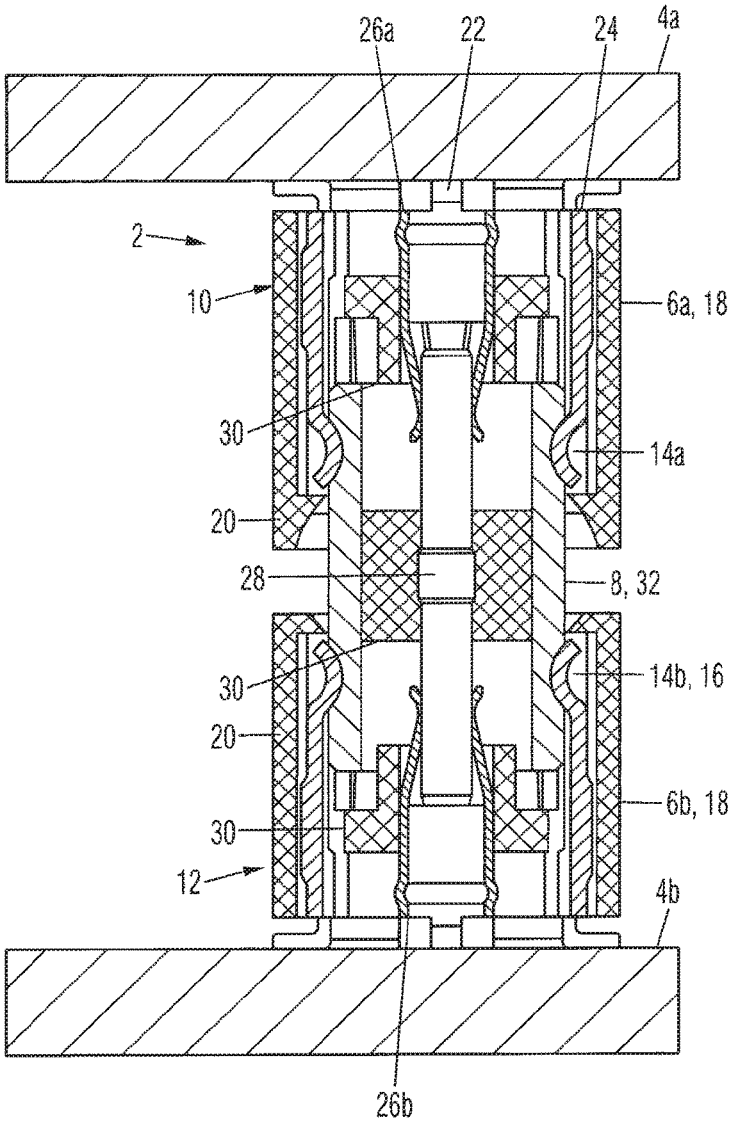

(51) Int. Cl.

| | |
|---|---|
| ***H01R 12/71*** | (2011.01) |
| ***H01R 12/73*** | (2011.01) |
| ***H01R 12/91*** | (2011.01) |
| ***H01R 24/50*** | (2011.01) |
| ***H01R 13/627*** | (2006.01) |
| ***H01R 13/20*** | (2006.01) |
| *H01R 103/00* | (2006.01) |
| *H01R 24/54* | (2011.01) |

(52) U.S. Cl.
CPC ..... *H01R 12/91* (2013.01); *H01R 13/20* (2013.01); *H01R 13/6277* (2013.01); *H01R 24/50* (2013.01); *H01R 13/6275* (2013.01); *H01R 24/542* (2013.01); *H01R 2103/00* (2013.01)

(58) Field of Classification Search
USPC ..... 439/607.34, 578
See application file for complete search history.

(56) References Cited

U.S. PATENT DOCUMENTS 4,290,440 A * 9/1981 Sturgis ..... F16K 17/383 137/75
4,346,958 A * 8/1982 Blanchard ..... H01R 24/40 439/584
4,795,370 A * 1/1989 Freitag ..... H01R 24/40 439/584
5,516,303 A * 5/1996 Yohn ..... H01R 13/6315 439/248
5,879,177 A * 3/1999 Honma ..... H01R 13/6315 439/246
6,497,579 B1 * 12/2002 Garbini ..... H01R 13/6315 439/246
6,776,668 B1 8/2004 Scyoc et al.
7,118,383 B2 * 10/2006 Nagata ..... H01R 13/6315 439/63
7,416,418 B2 * 8/2008 Berthet ..... H01R 24/50 439/63
8,734,167 B2 * 5/2014 Aimoto ..... H01R 13/187 439/74
8,801,459 B2 * 8/2014 Mrowka ..... H01R 24/54 439/246
9,281,641 B2 * 3/2016 Baechle ..... H01R 12/716
9,484,688 B2 * 11/2016 Hugel ..... H01R 24/542
10,027,053 B2 * 7/2018 Antonini ..... H01R 9/05
2006/0099853 A1 5/2006 Sattele et al.
2008/0297288 A1 * 12/2008 Irwin ..... H01F 7/1615 335/254
2012/0295478 A1 11/2012 Mrowka
2015/0118904 A1 * 4/2015 Baechle ..... H01R 12/716 439/591

* cited by examiner

PLUG-AND-SOCKET CONNECTOR

FIELD OF THE INVENTION

The invention relates to a connector for the HF signal-transmitting connection of two components.

TECHNICAL BACKGROUND

Board-to-board connectors are utilized for interconnecting two components, such as, for example, two circuit boards, two housings, or a circuit board to a housing, in such a way that electronic components on the two circuit boards can communicate with each other via exchange of HF signals.

It is known to produce such a connection between two circuit boards by means of two different coaxial plug-and-socket connectors fixedly connected to the circuit boards, and an adapter connecting the two coaxial plug-and-socket connectors, the so-called bullet. This adapter allows for an axial and radial tolerance compensation, and for compensation of parallelism tolerances. Typical coaxial plug-and-socket connectors utilized for this purpose are, for example, P-SMP, SMP, mini SMP, long-wipe SMP, MBX, SMP-MAX or FMC.

U.S. Pat. No. 6,776,668 B1 also describes a coaxial contact element, with the aid of which HF signals can be transmitted between two circuit boards. An inner conductor, which is designed in the form of a spring-loaded contact pin, is used as a signal conductor, while an outer conductor enclosing the inner conductor performs the function of a return conductor and of a shield for the inner conductor. The outer conductor comprises a sleeve-shaped main body which is slotted multiple times in the longitudinal direction. The non-slotted end of the main body forms, on the end face, a contact point for contacting a contact area of one of the circuit boards. A sleeve of the outer conductor is displaceably guided on the main body, which sleeve forms, at one end, on the end face, a contact point for contacting a contact area of the other circuit board. A preloaded spring is supported between the main body and the sleeve. During the connection of the two circuit boards, the head of the inner conductor designed in the form of a spring contact pin and the sleeve of the outer conductor are both displaced as the preload of the particular springs continues, whereby a secure contact pressure can be provided despite possible tolerances with respect to the distance between the contact areas of the circuit boards.

Due to the slotting of the main body, this main body also has a certain flexibility in the lateral direction, which is intended to ensure that cases of relatively great nonparallelism between the two contact areas can be compensated for.

The variants of the three-part board-to-board connections known so far and the coaxial contact element known from U.S. Pat. No. 6,776,668 B1 are relatively complex in terms of structure, manufacturing, and assembly. In addition, the capability to compensate for axial tolerances is relatively limited. Furthermore, the capability to compensate for nonparallelism of the contact areas to be connected is also relatively limited.

In light of the described problem, the object of the present invention is to provide an improved connector for the HF signal-transmitting connection of two components, in particular a board-to-board connector for the HF signal-transmitting connection of two circuit boards.

This object is achieved by a connector according to claim 1. Advantageous refinements of the invention are described in the dependent claims.

The connector according to the invention for the HF signal-transmitting connection of two components, in particular a board-to-board connector for the HF signal-transmitting connection of two circuit boards, comprises a first connecting piece for fastening to the first component and a second connecting piece for fastening to the second component, and an intermediate piece including a first end for connection to the first connecting piece and including a second end for connection to the second connecting piece. In order to form a detent connection for fixing the connection, the first connecting piece and the second connecting piece each comprise a first detent means, wherein the first end is designed to be free from detent means and the second end comprises a second detent means designed for interacting with the first detent means. In this case, HF (high frequency) signals are understood to be signals, for example, that systems utilize for wireless data transmission. In electrical engineering, the frequency range from 9 kHz up to long wave light (THz range) is referred to as high frequency.

The invention is based on the finding that a tolerance compensation of a distance between two components can be achieved in that a fixation of the connection between the intermediate piece and the connecting piece takes place only at one of the two ends, while the other end can move in a tolerance-compensating manner. Due to the fact that the intermediate piece comprises two different ends, specifically one end including the second detent means and an end free from detent means, the first and the second connecting pieces can be structurally identical. This simplifies the connection of two components, since connector components do not need to be assigned to the components before the soldering process for producing the connection, which reduces the logistics complexity for manufacturing. Furthermore, the use of structurally identical connecting pieces reduces the costs for the manufacturing thereof.

It is understood, however, that the first detent means of the first connecting piece and the first detent means of the second connecting piece can also differ, provided they are suitable for engaging with the second detent means.

In one preferred embodiment of the invention, the second detent means comprises an annular groove on an outer lateral face of the intermediate piece. In this way, the second detent means can be manufactured particularly easily, for example by means of pressing or milling. Furthermore, the design as an annular groove allows for a connection of the intermediate piece to the connecting pieces that is independent of the angular position, since the annular groove does not specify an angular position. In this way, the manufacturing is further simplified.

In yet another preferred embodiment of the invention, the first detent means comprises a resilient contact blade. Such resilient elements can be cost-effectively manufactured as punched-bent parts.

In yet another preferred embodiment of the invention, the first connecting piece and/or the second connecting piece include a limiting means which limits a deflection movement of the first detent means. In this way, permanent damage to the first detent means, for example, due to overloading resulting from excessive deflection, is reliably prevented, which could result, for example, in a breakage of the first detent means designed as resilient contact blades.

In yet another preferred embodiment of the invention, the limiting means is manufactured from an electrically insulating material. Therefore, no additional protective measures are required in order to prevent an unwanted current or signal flow across the limiting means. In this case, an electrically insulating material is understood as a non-conductor, the electrical conductivity of which, at less than $10^{-8}$, is extremely small and lies below that of semiconductors. Thus, no additional protective measures are required to prevent undesired current or signal flow across the limiting means.

In yet another preferred embodiment of the invention, the limiting means is formed by an inner wall of a housing having a basic shape which is cylindrical. The housing therefore has a double function, specifically to protect the first and the second connecting pieces, for example, against mechanical damage or contamination, and to provide the limiting means. In this way, a connector having a particularly simple design is provided.

In yet another preferred embodiment of the invention, the connector comprises an inner conductor and an outer conductor. The connector therefore has a coaxial conductor design in which the outer conductor functions as a shield for the inner conductor against stray electromagnetic radiation.

The invention further comprises an assembly including a first component and a second component, wherein the first component and the second component are connected to each other by means of such a connector.

Preferably, it is also provided to connect the outer conductor to an insulating part by means of a form-locked connection or by pressing, i.e., by means of a press fit. The inner conductor is connected to the insulating part, for example, by means of a press fit or by means of a form-locked connection.

Further preferably, the insulating part comprises a protective collar for protecting or "catching" the inner conductor.

According to yet another preferred embodiment, the first and/or the second connecting piece comprise/comprises an insulating means which forms an insulation between the inner conductor and the outer conductor and a housing. This embodiment is particularly cost-effective and reduces the number of individual parts of a plug-and-socket connector according to the invention.

According to yet another preferred embodiment, the insulation has a substantially double "U" or meandering cross-section having an installation opening.

According to yet another preferred embodiment, the outer conductor comprises the first detent means. The combination of a contact means, which is required anyway, in the outer conductor with a detent means saves parts and therefore proves to be particularly cost-effective. It is also conceivable to form a detent means on another element of the connector according to the invention.

Circuits which change an electrical signal in the amplitude and in the phase position depending on the frequency are referred to in electrical engineering and telecommunications as filters. As a result, unwanted signal components can be attenuated or suppressed.

According to yet another preferred embodiment, the first and/or the second connecting piece can be connected to, in particular pressed into or screwed into a socket, in particular a filter socket, via its outer conductor.

According to yet another preferred embodiment, the first and/or the second connecting piece comprise/comprises a two-piece outer conductor including an exterior outer conductor sleeve and an interior outer conductor. A two-piece outer conductor is particularly suitable for a screw connection of the associated connecting piece to a socket. In this way, the required stability can be ensured by means of the outer conductor sleeve and a secure, resilient contacting can be ensured by means of an interior outer conductor part.

According to yet another preferred embodiment, an intermediate piece-side end of the first and/or the second connecting piece are/is designed in the shape of a funnel. The funnel makes it easy to plug in the connector according to the invention. This is advantageous, in particular, in hard-to-access areas or systems, such as transmitter towers.

Figure 2:
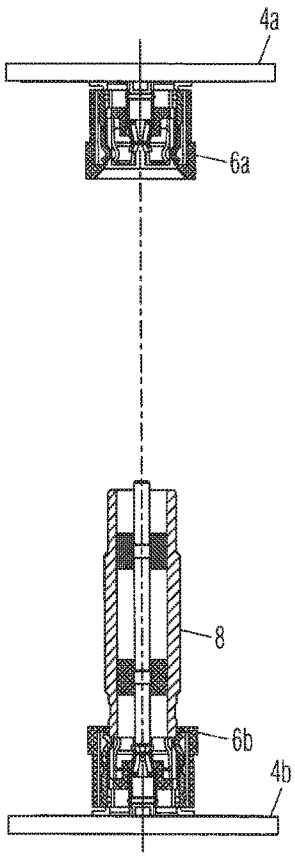
Figure 3:
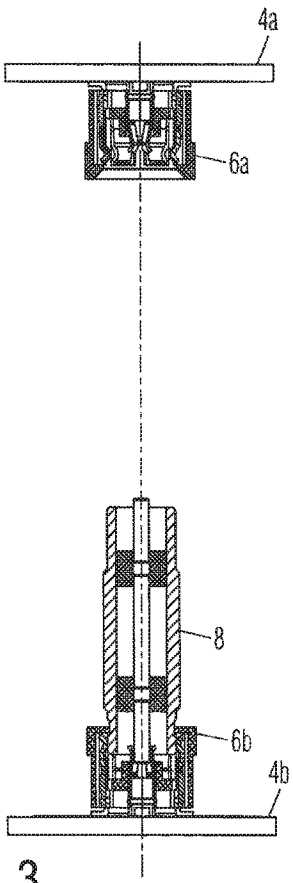
Figure 4:
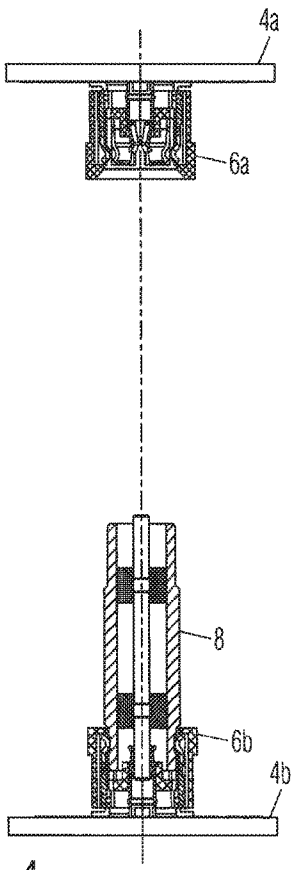
Figure 7:
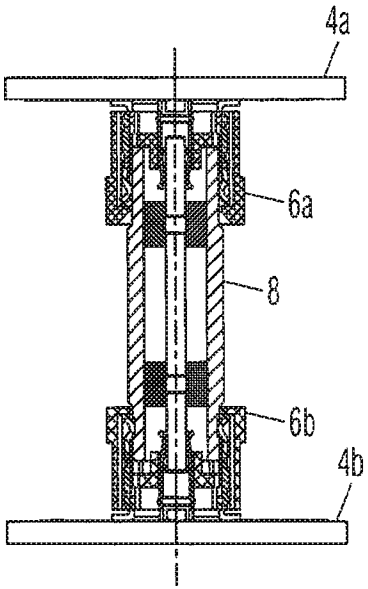
Figure 6:
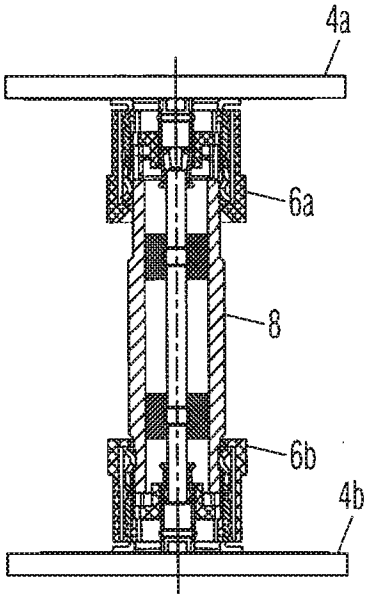
Figure 5:
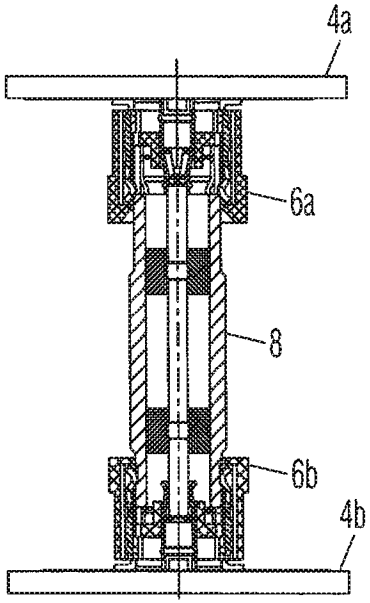
Figure 8:
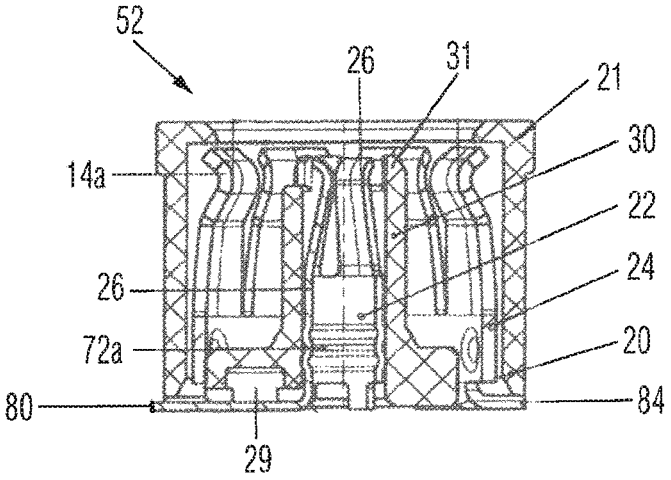
Figure 9:
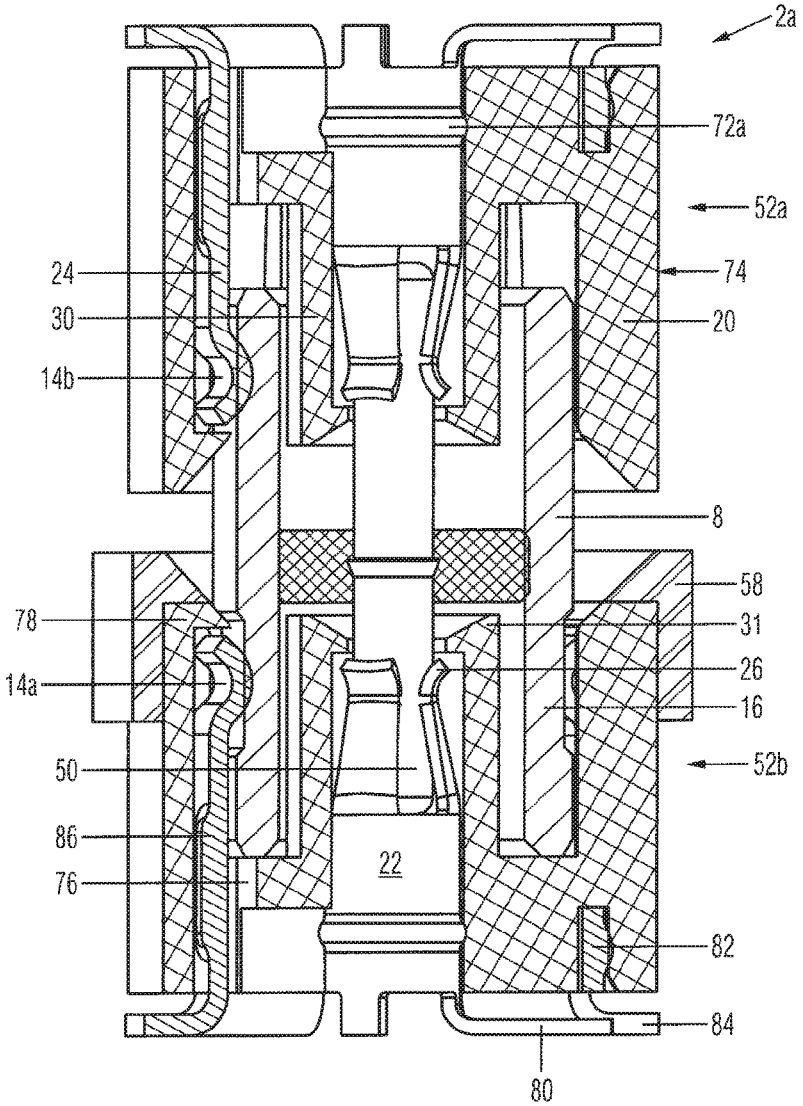
Figure 10:
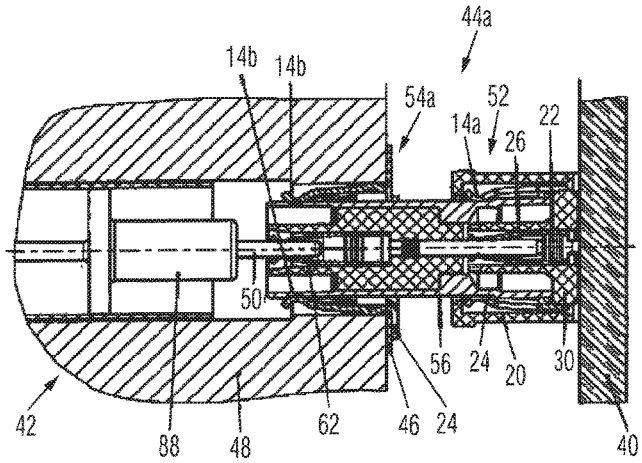
Figure 11:
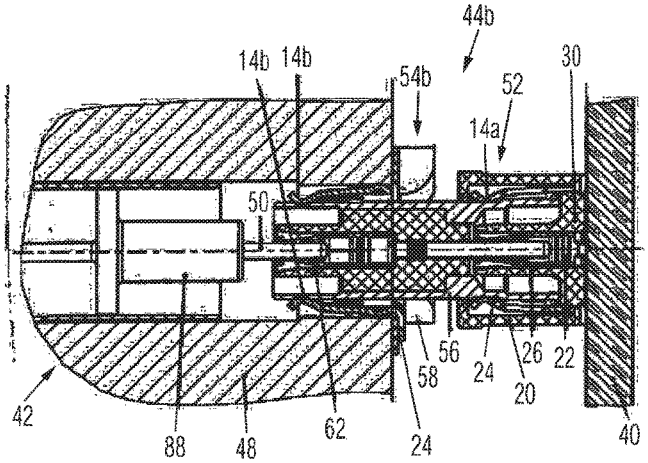
Figure 12:
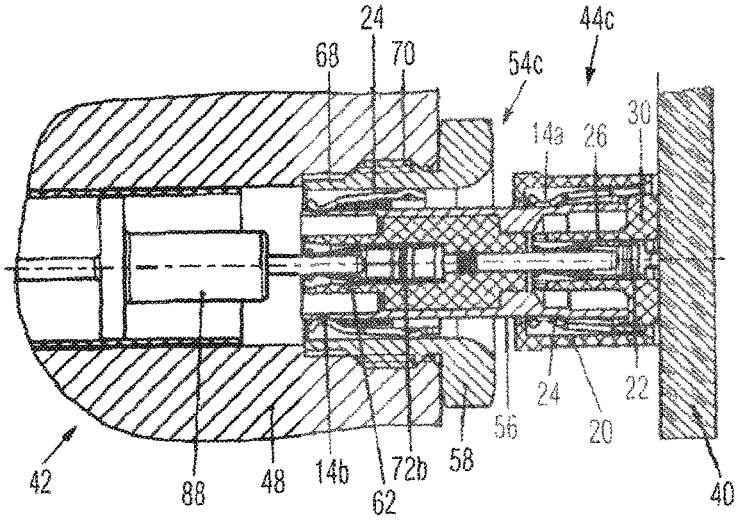
Figure 13:
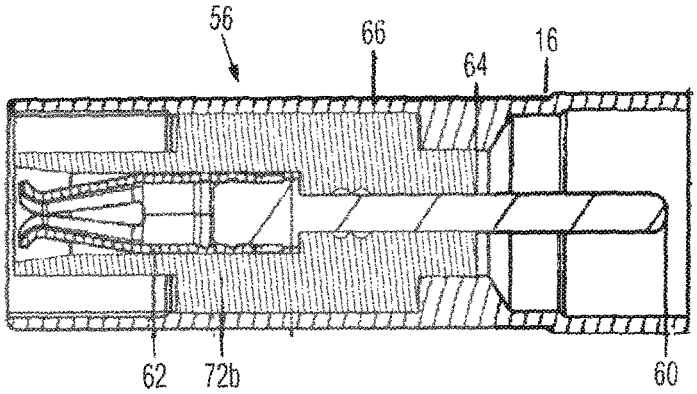

The invention is described in the description that follows, with reference to the attached drawings. In the drawings:

FIG. 1 shows a schematic sectional representation of one embodiment of a connector according to the invention, FIG. 2 shows a first step in the production of a connection between a first and a second component, FIG. 3 shows a second step in the production of a connection between a first and a second component, FIG. 4 shows a third step in the production of a connection between a first and a second component, FIG. 5 shows a fourth step in the production of a connection between a first and a second component, FIG. 6 shows a fifth step in the production of a connection between a first and a second component, and FIG. 7 shows a sixth step in the production of a connection between a first and a second component, FIG. 8 snows a schematic sectional representation of a connecting piece according to the invention, FIG. 9 shows a schematic sectional representation of yet another embodiment of connector according to the invention, FIG. 10 shows a schematic sectional representation of one embodiment of a connector according to the invention, FIG. 11 shows a schematic sectional representation of one embodiment of a connector according to the invention, FIG. 12 shows a schematic sectional representation of one embodiment of a connector according to the invention, and FIG. 13 shows a schematical sectional representation of an intermediate piece according to the invention.

Reference is initially made to FIG. 1. FIG. 1 shows a connector 2 which connects a first component 4*a* to a second component 4*b* in such a way that HF signals can be transmitted between the components 4*a* and 4*b*. In the present exemplary embodiment, the connector 2 is a board-to-board connector for connecting a first circuit board to a second circuit board, and so electronic components (not shown) on the first circuit board 4*a* and on the second circuit board 4*b* can communicate with each other via exchange of HF signals.

For this purpose, the connector 2 in the present exemplary embodiment comprises an inner conductor 22 and an outer conductor 24, wherein the outer conductor 24 shields the inner conductor 22 in order to improve the transmission quality. In other words, the connector 2 has a concentric coaxial conductor design in the present exemplary embodiment, in which the inner conductor 22 (also referred to as the core) is enclosed by a hollow cylindrical outer conductor 24. The outer conductor 24 shields the inner conductor 22 against stray electromagnetic radiation.

As will be described further below, the inner conductor 22 and the outer conductor 24 are electrically conductively connected to particular connections of the first component 4*a* and of the second component 4*b*, respectively, and are fastened to the component 4*a*, 4*b*, respectively. Different solder connections or press-fit connections are conceivable as the connection.

In the present exemplary embodiment, the connector 2 comprises a first connecting piece 6*a*, a second connecting piece 6*b*, and an intermediate piece 8, wherein the first connecting piece 6*a* and the second connecting piece 6*b* are structurally identical in the present exemplary embodiment. The first connecting piece ha and the second connecting piece 6*b* function as couplers, while the intermediate piece 8 functions as an adapter.

The two connecting pieces 6*a*, 6*b* each comprise a housing 20 which is injection-molded using an electrically insulating plastic material. The housing 20 has a basic shape which is substantially cylindrical and has open end faces.

In the present exemplary embodiment, a plurality of first detent means 14*a*, 14*b* is disposed in the interior of the housing 20, which detent means are each formed by a resilient contact blade and form a connecting piece detent means in the present exemplary embodiment. The first detent means 14*a*, 14*b* are circularly disposed around the inner conductor 22 and are uniformly spaced apart in the circumferential direction. Furthermore, the first detent means 14*a*, 14*b* are designed in such a way that they are deflected radially outwardly during the connection to the intermediate piece 8. Such a deflection movement is limited, in this case, by an inner wall of the housing 20 acting as a limiting means 18 or a stop. In the present exemplary embodiment, the limiting means is designed as a radial limiting means.

In the exemplary embodiments described, the two connecting pieces 6*a, b* and 52 and 54*a-c* comprise detent means. The intermediate piece 8 or 56 has a second detent means 16 on only one side, however. In the drawings, the detent means 14*b* is assigned to the side of the intermediate piece 8, 56 that is free from a detent means. As a result, the detent means 14*b* functions only as a contact means and does not engage with the intermediate piece 8, 56. The detent means 14*b* can therefore also be replaced by a contact means. In order to keep the storage costs and the complexity of a connector according to the invention low, however, the detent means 14*b* has not been replaced by a contact means.

Moreover, an inner conductor receptacle 26*a*, 26*b* is disposed in the interior of the housing 20 and is designed for accommodating and electrically contacting, for example, via spring elements, a section of an intermediate conductor 28—which is rod-shaped in the present exemplary embodiment—of the intermediate piece 8.

In the present exemplary embodiment, insulating parts 30 are disposed between the first detent means 14*a*, 14*b* and the intermediate conductor 28, which insulating parts electrically insulate the intermediate conductor 28 against the outer conductor 24, wherein the first detent means 14*a*, 14*b* form a section of the outer conductor 24 in this case.

The intermediate piece 8 in the present exemplary embodiment comprises a main body 32 having a basic shape which is substantially cylindrical. The intermediate conductor 28 is disposed in the interior of the intermediate piece 8 and forms a section of the inner conductor 22, while the main body 32 itself forms a section of the outer conductor 24.

In the present exemplary embodiment, insulating parts 30 which electrically insulate the intermediate conductor 28 against the main body 32 are disposed between the intermediate conductor 28 and the main body 32.

The intermediate piece 8 has a first end 10 and a second end 12, wherein the first end 10 is assigned to the first connecting piece 6*a* and the second end 12 is assigned to the second connecting piece 6*b*. At the first end 10, the intermediate piece 8 is designed to be free from detent means. Therefore, a fixation of the intermediate conductor 28 in the axial direction via an engagement of two detent means into each other is not given on the first end 10. On the second end 12, however, the intermediate piece 8 comprises a second detent means 16 which interacts with the second detent means 14*b* of the second connecting piece 6*b*, i.e., is engaged therewith, in order to fix the connection between the second connecting piece 6*b* and the intermediate piece 8 by forming a detent connection. In this case, the second detent means 16 forms an intermediate piece detent means.

In the present exemplary embodiment, the second detent means 16 is an annular groove on an outer lateral face of the main body 32 of the intermediate piece 8. In the present exemplary embodiment, the annular groove extends around the main body 32 of the intermediate piece 8.

Therefore, HF signals can be transmitted to the second component 6*b*, during operation, from the first component 4*a* via the intermediate conductor 28, i.e., via the inner conductor receptacle 26*a* of the first connecting piece 6*a*, the intermediate conductor 28 of the intermediate piece 8, and via the inner conductor receptacle 26*b* of the second connecting piece 6*b*.

An HF signal can be conducted from the second component 4*b* back to the first component 4*a* or the inner conductor 22 can be shielded against stray electromagnetic radiation via the outer conductor 24, i.e., via the second detent means 14*b* which is in electrically conductive contact with the main body 32, via the main body 32 itself, and via the first detent means 14*a* which is engaged with the second detent means 16 of the intermediate piece 8.

Reference is now additionally made to FIG. 2 to FIG. 7 in order to describe the production of a connection between the first component 4*a* and the second component 4*b* in order to transmit HF signals.

In a first step (see FIG. 2), the first connecting piece 6*a* is fastened on the first component 4*a*, e.g., via soldering, in order to thereby produce electrical connections between the inner conductor 22 and the outer conductor 24 as well as the electrical components of the first component 4*a*.

Similarly, in the first step, the second connecting piece 6*b* is fastened on the second component 4*b* in order to thereby produce electrical connections between the inner conductor 22 and the outer conductor 24 as well as the electrical components of the second component 4*b*.

Furthermore, in the first step, the intermediate piece 8 is placed onto the second connecting piece 6*b*.

In a second step (see FIG. 3), the intermediate piece 8 is moved in the direction of the second component 4*b* so far that the first detent means 14*b* of the second connecting piece 6*b* is deflected by a maximum extent, wherein this deflection movement is limited by the limiting means 18 formed by the inner wall of the housing 20.

The intermediate conductor 28 simultaneously comes into contact with the inner conductor receptacle 26*b*.

In a third step ((FIG. 4), the intermediate piece 8 reaches its end position relative to the second connecting piece 6*b*, in which the lower end section of the intermediate conductor 28 is accommodated and held in the inner conductor receptacle 26*b*. Furthermore, the first detent means 14*b* of the first connecting piece 6*b* engages with the second detent means 16, and so the connection is fixed.

In a fourth step (FIG. 5), the first component 4*a*, including the first connecting piece 6*a*, is placed onto the intermediate piece 8 and the first component 4*a* and the second component 4*b* are moved toward each other, similarly to the first step (see FIG. 1).

In a fifth step (FIG. 6), the intermediate piece 8 is moved in the direction of the first component 4*a* so far that the first detent means 14*a* of the first connecting piece 6*a* is deflected by a maximum extent, similarly to the second step (see FIG. 3).

In a sixth step (FIG. 7), the intermediate piece 8 reaches its end position relative to the first connecting piece 6*a*, in which the upper end section of the intermediate conductor 28 is accommodated and slidingly held in the inner conductor receptacle 26*a*.

Due to the second end 10 of the intermediate piece 8, which is free from detent means, a tolerance compensation of 1 mm in the axial direction of the intermediate conductor 28 is ensured. Furthermore, a radial tolerance compensation of 4° or a maximum of 0.6 mm can be achieved.

Instead of a component 4*a*, 4*b* comprising a connecting piece 6*a*, 6*b*, other attachments can also be installed, as an alternative, such as, for example, catch funnels, EMC shielding, straight or angled cable connectors, and housing couplers.

A connecting element is therefore provided in the form of the connector 2 which, despite having tolerance-compensating properties, is distinguished by being cost-effective to manufacture, by having a simple and, therefore, non-error-prone design, and being easy to install.

FIG. 8 shows a circuit board-side connecting piece 52 according to the invention. The connecting piece 52 comprises a housing 20, an outer conductor 24, an inner conductor 22, and an insulating part 30. The inner conductor 22 comprises a spring cage 26. The housing 20 functions as an external insulating, means and serves to protect the outer conductor 24. On the front side, the housing 20 has a protruding protective edge 21 for protecting the front side of the outer conductor 24. On the underside of the connecting piece 52, the outer conductor 24 comprises multiple tabs 84, at which the outer conductor can be electrically and mechanically connected to a circuit board. Different solder connections or press-fit connections are conceivable as the connection.

The insulating part 30 is formed between the outer conductor 24 and the inner conductor 22. The insulating part 30 is designed to be peripheral and comprises multiple circular recesses 29 on its circuit board-side end. The recesses 29 are used for the electrical accommodation of the connector. The insulating part 30 also has an installation hole (not shown) which is adjacent to the recess 29.

The inner conductor 22 is held within the insulating part 30 by way of the spring cage 26. The spring cage 26 functions as a receptacle for the pin 50 and ensures tolerance compensation. The spring cage 26 has a wavy surface 72*a* for the purpose of producing a form-locked connection between the spring cage 26 and the insulating part 30. The insulating part has multiple insulating tips 31 for the purpose of protecting the contact blades of the spring cage 26.

The outer conductor 24 comprises multiple resilient contact blades. In a front-side area of the contact blades, the first detent means 14*a* and 14*b* are designed as an inward deformation of the contact blades.

FIG. 9 shows yet another embodiment of a connector 2*a* according to the invention. The connector 2*a* is designed as a board-to-board connector between two circuit boards (not shown). The connecting pieces of the connector can be combined with other connecting pieces, however, and so the connecting piece 52*a* or *b* as well as the intermediate piece 56 are also suitable for use, for example, as a board-to-filter connector.

The connector 2*a* comprises one circuit board-side connecting piece 52*a, b* and one intermediate piece 8. The connecting pieces 52*a, b* differ in terms of a catch funnel 58, In this embodiment, only the connecting piece 52*b* comprises a catch funnel 58. The catch funnel makes it easier to find the parts to be plugged in, in systems that are difficult to access. An improved way of finding a plug connector is advantageous, for example, during installation on a transmitter tower.

The connecting pieces 52*a, b* also comprise an insulating means 74 which simultaneously forms an outer housing or an outer insulating means as well as an inner insulating part between the inner conductor and the outer conductor. The insulating means 74 is designed to have a meandering shape or a double "U" shape including an installation opening 76. The double "U" shape has an inner bulge, in which the inner conductor 22 is disposed. The tip of the inner bulge comprises, on its front side, an insulating tip 31 for protecting the inner conductor 22 or the spring cage 26 holding the inner conductor 22. As a result, the area between the inner conductor 22 and the outer conductor 24 of the insulating means 74 forms an insulating part 30. The outer wall of the double "U"-shaped insulating means forms an insulating outer housing 20 or an outer insulating part. The installation opening 76 is apparent between the inner and the outer areas of the insulating means 74. As a result, a person skilled in the art will understand the term "meandering or double 'U'-shaped" to be a shape having high areas and low areas, which can also include openings. The insulating means 74 is connected to the outer conductor 24 via the form-locked connection 82. Alternatively, a connection can also be produced via a force-locked connection, for example, a press fit. Behind the opening 76, the form-locked connection 86 forms a further connection between the outer conductor 24 and the insulating means 74.

On the underside of the connecting piece 52*a, b*, the outer conductor comprises tabs 84, via which the outer conductor can be soldered to a circuit board.

The inner conductor comprises a tab 80 which functions as an electrical connection.

FIGS. 10 to 12 are described in an overlapping manner in the following. FIGS. 10 to 12 show different embodiments 44*a, b, c*, respectively, of a board-to-filter connection according to the invention.

The connectors 44*a, b, c* each comprise a circuit board-side connecting piece 52 of the type described above with reference to FIG. 8. The connecting piece is soldered to the circuit board 40. Furthermore, the connectors 44*a, b, c* comprise a filter-side connecting piece 54*a, b, c*, respectively. The filter-side connecting piece 54*a, b, c* is connected to the filter 42 in a hole of the filter housing 48 in each case.

In FIG. 10, the filter-side connecting piece 54*a* comprises an outer conductor 24 and an insulating disk 46. The connecting piece 54*a* has been pressed together with the filter housing 48.

The outer conductor 24 of the connecting piece 54*a* comprises a first detent means 14*b* which functions only as a contact means. The intermediate piece 56 does not have a second detent means on the filter side.

The connecting pieces 54*a* and 52 of the connector 44*a* are connected via the intermediate piece 56. The intermediate piece 56 is radially held and contacted on the filter side and on the circuit-board side by the detent means 14*a, b*. On the circuit-board side, the intermediate piece 56 has a step which forms the second detent means 16. The step prevents the intermediate piece 56 from slipping out of the connecting piece 52. The filter-side contact blades 62 of the intermediate piece 56 accommodate a contact pin 50 of the filter 42.

Similarly to FIG. 10, FIG. 11 shows a connector 44*b* including a connecting piece 54*b* which is pressed together with a filter 42. The connector 44*b* in FIG. 11 differs from the connector 44*a* in FIG. 10 in terms of a catch funnel 58. The catch funnel is fastened on the insulating disk 46 and facilitates the insertion of the intermediate piece 56 into the connecting piece 54*b*.

FIG. 12 shows yet another embodiment of a connector 44*c* which is similar to the connectors 44*a, b*. The connector 44*c* comprises a connecting piece 54*c* including a two-piece outer conductor. The two-piece outer conductor comprises an outer conductor sleeve 68 and an interior outer conductor 24. The outer conductor sleeve 68 includes a thread step 70, on which the outer conductor sleeve 68 is screwed into a hole in the filter housing 48. The hole in the filter housing 48 has an inner contour corresponding to the outer conductor sleeve 68. The outer conductor sleeve is connected to the interior outer conductor 24 in a form-locked manner. On the front side, the outer conductor sleeve 68 comprises a catch funnel 58.

FIG. 13 shows an intermediate piece 56 according to the invention for a board-to-filter connector 44*a, b, c*. The intermediate piece 56 comprises an inner conductor 60 which is designed, at its circuit-board side end, as an exposed pin. The intermediate piece 56 also comprises an outer conductor 66 which simultaneously forms a housing of the intermediate piece 56. An insulating part 64, which holds the inner conductor 60 in the outer conductor 66, is formed between the outer conductor 66 and the inner conductor 60. At a filter-side end of the inner conductor 60, this inner conductor comprises a spring cage 62. The spring cage 62 has a wavy surface 72*b* in one area, which effectuates a form-locked connection between the spring cage 62 and the inner conductor 60 and between the spring cage 62 and the insulating part 64. The spring cage 62 ensures tolerance compensation and assists in finding the plug connector, in that a filter-side pin is to be inserted into the contact blades of the spring cage 62.

The insulating part forms, on its filter-side end, a protruding wall for protecting the contact blades.

LIST OF REFERENCE NUMBERS

2 connector
2*a* connector
4*a* component
4*b* component
6*a* connecting piece
6*b* connecting piece
8 intermediate piece
10 first end
12 second end
14*a* first detent means
14*b* first detent means
16 second detent means
18 limiting means
20 housing
22 inner conductor
24 outer conductor
26 spring cage
26*a* per conductor receptacle
26*b* inner conductor receptacle
28 intermediate conductor
29 recess
30 insulating part
31 insulating tip
32 main body
40 circuit board
42 filter
44*a* connector
44*b* connector
44*c* connector
46 insulating risk
48 filter housing
50 pin
52 connecting piece
52*a* connecting piece
52*b* connecting piece
54*a* connecting piece
54*b* connecting piece
54*c* connecting piece
56 intermediate piece
58 catch funnel
60 inner conductor
62 spring cage
64 insulating part
66 housing
68 outer conductor sleeve
70 thread step
72*a* wavy surface
72*b* wavy surface
74 insulating means
76 opening
78 protection area
80 tab
82 form-locked connection
84 holding means
86 form-locked connection
88 filter inner conductor

The invention claimed is:

1. A connector, comprising
a first terminal connector;
a second terminal connector; and
an intermediate component comprising an outer conductor and an inner conductor in coaxial arrangement to said outer conductor, said outer conductor comprising a first end and a second end,
exclusively one of said first end and said second end comprising a counterpart detent portion, and
each of said first terminal connector and said second terminal connector comprising a detent portion selectively engageable with said counterpart detent portion.

2. The connector of claim 1, wherein:
an outer surface of said intermediate component comprises a groove, said groove constituting at least part of said counterpart detent portion.

3. The connector of claim 1, wherein:
said detent portion of at least one of said first terminal connector and said second terminal connector comprises a resilient contact blade that contacts an outer surface of said intermediate component.

4. The connector of claim 3, wherein:
said resilient contact blade contacts said outer surface in an engaged configuration of said intermediate component and said at least one of said first terminal connector and said second terminal connector.

5. The connector of claim 1, wherein:
at least one of said first terminal connector and said second terminal connector comprises a limiting portion that limits a range of motion of said detent portion of said at least one of said first terminal connector and said second terminal connector.

6. The connector of claim 5, wherein:
said limiting portion of said at least one of said first terminal connector and said second terminal connector is composed of an electrically insulating material.
7. The connector of claim 5, wherein:
said at least one of said first terminal connector and said second terminal connector comprises a housing, a cylindrical inner wall of said housing constituting the respective limiting portion of said at least one of said first terminal connector and said second terminal connector.
8. The connector of claim 1, wherein:
said connector is an RF connector, and
said intermediate component comprises an insulating portion that insulates said inner conductor from said outer conductor.
9. A connector, comprising
a first terminal connector;
a second terminal connector; and
an intermediate component comprising a first end and a second end,
in a first configuration, said first terminal connector is electrically connected to second terminal connector via said intermediate component, said first terminal connector being electrically connected to said first end and said second terminal connector being electrically connected to said second end, a retaining force retaining said first end in said first terminal connector being substantially higher than a retaining force retaining said second end in said second terminal connector,
in a second configuration, said first terminal connector is electrically connected to second terminal connector via said intermediate component, said first terminal connector being electrically connected to said second end and said second terminal connector being electrically connected to said first end, wherein
said first end comprises a counterpart detent portion,
said first terminal connector comprises a detent portion, and
an outer surface of said intermediate component comprises a groove, said groove constituting at least part of said counterpart detent portion.
10. The connector of claim 9, wherein:
in said second configuration, a retaining force retaining said first end in said second terminal connector is substantially higher than a retaining force retaining said second end in said first terminal connector.
11. The connector of claim 9, wherein:
said connector is an RF connector.
12. The connector of claim 9, wherein:
said retaining force retaining said first end in said first terminal connector results from an engagement of said counterpart detent portion and said counterpart detent portion.
13. The connector of claim 9, wherein:
said detent portion comprises a resilient contact blade that contacts an outer surface of said intermediate component.
14. The connector of claim 13, wherein:
said resilient contact blade contacts said outer surface in said first configuration.
15. The connector of claim 12, wherein:
said first terminal connector comprises a limiting portion that limits a range of motion of said detent portion.
16. The connector of claim 15, wherein:
said limiting portion is composed of an electrically insulating material.
17. The connector of claim 15, wherein:
said first terminal connector comprises a housing, a cylindrical inner wall of said housing constituting said limiting portion.
18. The connector of claim 9, wherein:
said first terminal connector comprises a detent portion, and
of said first end and said second end, exclusively said first end comprises a counterpart detent portion snappingly engageable with said detent portion.
19. A connector, comprising
a first terminal connector comprising a first detent portion in an interior of said first terminal connector;
a second terminal connector comprising a second detent portion in an interior of said second terminal connector; and
an intermediate component comprising a first end and a second end,
exclusively one of said first end and said second end comprising a counterpart detent portion, and
each of said first detent portion and said second detent portion being selectively engageable with said counterpart detent portion.
20. The connector of claim 19, wherein:
said connector is a coaxial RF connector.
21. A connector, comprising
a first terminal connector;
a second terminal connector; and
an intermediate component comprising a first end portion, a second end portion and an intermediate portion intermediate said first end and said second end,
exclusively one of said first end portion and said second end portion comprising a counterpart detent portion,
each of said first terminal connector and said second terminal connector comprising a detent portion selectively engageable with said counterpart detent portion,
in a fully engaged state of said connector, said first end portion is radially inward of said first terminal connector, said second end portion is radially inward of said second terminal connector and said intermediate portion is neither radially inward of said first terminal connector nor radially inward of said second terminal connector.
22. The connector of claim 21, wherein:
said connector is a coaxial RF connector.
23. The connector of claim 21, wherein:
said intermediate portion is longer than each of said first end portion and said second end portion.

* * * * *